United States Patent [19]

Spreadbury

[11] Patent Number: 4,501,994

[45] Date of Patent: Feb. 26, 1985

[54] BALLAST MODIFYING DEVICE AND LEAD-TYPE BALLAST FOR PROGRAMMING AND CONTROLLING THE OPERATING PERFORMANCE OF AN HID SODIUM LAMP

[75] Inventor: Robert J. Spreadbury, Murrysville, Pa.

[73] Assignee: Cooper Industries, Inc., Houston, Tex.

[21] Appl. No.: 522,544

[22] Filed: Aug. 10, 1983

Related U.S. Application Data

[63] Continuation of Ser. No. 414,114, Sep. 2, 1982, abandoned, which is a continuation-in-part of Ser. No. 282,993, Jul. 14, 1981, abandoned, which is a continuation-in-part of Ser. No. 264,324, May 18, 1981, abandoned.

[51] Int. Cl.[3] ..... H05B 37/02

[52] U.S. Cl. ..... 315/307; 315/224; 315/247; 315/287; 315/308

[58] Field of Search ..... 315/224, 287, 247, 307

[56] References Cited

U.S. PATENT DOCUMENTS

| | | | |
|---|---|---|---|
| 3,015,058 | 12/1961 | Popa | 323/60 |
| 3,344,311 | 9/1967 | Nuckolls | 315/199 |
| 3,590,316 | 6/1971 | Engel | 315/209 R |
| 3,599,037 | 8/1971 | Grace | 315/151 |
| 3,689,752 | 9/1972 | Gilbert | 307/229 |
| 3,886,405 | 5/1975 | Kubo | 315/224 |
| 4,162,428 | 7/1979 | Elms | 315/284 |
| 4,162,429 | 7/1979 | Elms et al. | 315/284 |
| 4,292,570 | 9/1981 | Engel | 315/360 |
| 4,350,934 | 9/1982 | Spreadbury | 315/287 |

*Primary Examiner*—Harold Dixon

*Attorney, Agent, or Firm*—Spensley, Horn, Jubas & Lubitz

[57] ABSTRACT

Lead-type ballast apparatus operable to program and control the operating performance of a high-intensity-discharge sodium lamp. The basic lead-type ballast comprises a current-limiting high-reactance transformer having a capacitor connected between the transformer output terminals and the lamp to be operated. A pulse-generating means is normally associated with the transformer secondary and is operable to generate high-voltage pulses when the apparatus is energized which are applied through the capacitor to initiate a discharge within the lamp. There is also provided an additional inductor which is connected in circuit in one of (1) a parallel connection across the capacitor and (2) a connection across the transformer secondary. An "open or closed" switch connects in circuit with the additional inductor. A sensing and programming means operates to sense at least one lamp operating parameter to control the proportion of time the switch is open and closed, in order to vary the current input to the lamp. Any of a variety of lamp operating parameters may be sensed in order to control any of a plurality of desired lamp operating parameters.

24 Claims, 16 Drawing Figures

BALLAST MODIFYING DEVICE AND LEAD-TYPE BALLAST FOR PROGRAMMING AND CONTROLLING THE OPERATING PERFORMANCE OF AN HID SODIUM LAMP

This is a continuation of application Ser. No. 06/414,114 filed Sept. 2, 1982 which is a continuation-in-part of Ser. No. 06/282,993 filed July 14, 1981 which is a continuation-in-part of Ser. No. 06/264,324 filed on May 18, 1981 all of which are abandoned.

CROSS-REFERENCES TO RELATED APPLICATIONS

In application Ser. No. 414,275, filed Sept. 2, 1982 by Engel et al., now issued as U.S. Pat. No. 4,455,595 on June 19, 1984 and owned by the present assignee is disclosed an improved packaging concept for a programming and control device wherein all elements thereof are included in a unitary package formed similarly to a capacitor can of such dimensions as to be readily mounted in existing HID lamp fixture designs.

In application Ser. No. 414,276, filed Sept. 2, 1982 by Bhalla et al. now issued as U.S. Pat. No. 4,475,065 on Oct. 2, 1984 is disclosed a modified method for operating an HID sodium lamp wherein lamp voltage rise, which is normally encountered throughout lamp life, is minimized in order to minimize the lamp source color shifts which are normally encountered with some types of HID sodium lamps.

In application Ser. No. 414,115, filed Sept. 2, 1982 by J. C. Engel and owned by the present assignee is disclosed an improved programming and control device for a modified lead ballast for HID lamps. One embodiment of this programming and control device has been specifically tailored to operate HID sodium lamps in such manner that the lamp wattage is carefully controlled. In another embodiment, lamp voltage variations are minimized throughout lamp life.

BACKGROUND OF THE INVENTION

This invention relates to ballast apparatus for operating HID sodium lamps and, more particularly, to a lead-type ballast which programs and controls the operation of the HID sodium lamp.

Inductive ballasting devices for high-intensity-discharge (HID) devices are highly developed and are used to ballast high-pressure mercury lamps, high-pressure metal-halide lamps and high-pressure sodium lamps. The simplest of these ballast devices is a single reactor which can be used to ballast mercury lamps, providing the line voltage exceeds the minimum starting voltage required by the particular lamp. If the starting voltage exceeds the line voltage, the ballast can be formed as a high-reactance transformer which combines the transformer function and the ballasting function in the same core and coil assembly. For operation of mercury lamps, improved performance can be obtained by including a capacitor between the inductive reactance and the lamp. If the inductive component takes the form of an auto-transformer, these are referred to as constant wattage auto-transformer ballasts. If the lamp circuit is isolated from the line by means of a separate transformer, the ballast is known as a constant wattage type ballast. Both of these modifications which include a capacitor between the transformer and the lamp can be classed as lead-type ballasts. Such lead-type ballasts for mercury lamps have been made dimmable by incorporating a variable voltage source between the capacitor and the lamp. Thus, the voltage delivered to an operating lamp can be varied. Such a construction is disclosed in U.S. Pat. No. 3,015,058 dated Dec. 26, 1961. Another method for dimming such lamps is to utilize a plurality of parallel-connected capacitors between the transformer secondary and the lamp. By connecting and disconnecting the capacitors, the power delivered to an operating lamp can be varied.

Metal halide lamps are quite similar to the mercury lamp except that a higher voltage is needed to start the lamp and a higher reignition voltage must be present each half cycle. These requirements have led to the development of so-called lead-peak ballasts which utilize either a high reactance auto-transformer or an isolated transformer, with a capacitor connected in circuit between the transformer output and the lamp. U.S. Pat. No. 3,599,037 dated Aug. 10, 1971 discloses including a variable inductance between the capacitor and the lamp in order the control the current to the lamp. The variable inductance is controlled by a feedback signal which in turn is controlled by the light output of the operating lamp.

High pressure sodium lamp ballasts are of various designs and the most commonly used is the lead-peak type which includes a capacitor intermediate the transformer output and the lamp. Particularly in the case of high pressure sodium lamps, the lamp operating voltage tends to rise with burning time, with resulting increase in power consumption. This is the normal cause of failure for such lamps as determined by the inability of the ballast apparatus to operate a lamp at considerably higher-than-design voltage.

In recent years there have been developed a wide variety of control devices for sensing at least one HID lamp operating parameter and converting this sensed parameter into a signal which in turn is used to control a predetermined lamp operating parameter. One example of such a control device is described in U.S. Pat. No. 3,590,316, dated June 29, 1971. The circuit described therein senses lamp operating voltage and lamp operating current and converts this into a control signal which is representative of the actual lamp operating wattage. The control signal actuates control circuitry which maintains the operating lamp wattage at about a predetermined value. In another system, as described in U.S. Pat. No. 4,162,429, dated July 24, 1979, line voltage and operating lamp voltage are both sensed and converted into a signal which controls lamp wattage. In recent years, modified ballasts have been marketed which use a variable transconductance solid-state multiplier to measure the wattage input to an operating lamp. This is converted to a control signal which in turn operates to control the actual lamp wattage in a predetermined fashion. The basic transconductance multiplier circuit is described in U.S. Pat. No. 3,689,752, dated Sept. 5, 1972.

Another type of programming and control is described in U.S. Pat. No. 4,172,962, dated Apr. 3, 1979 wherein continuous time of lamp operation is sensed, and after a predetermined time has passed, the control circuitry automatically dims the operating lamp so that less power is consumed during the later portions of the nighttime when less illumination is needed.

U.S. Pat. No. 3,344,311, dated Sept. 26, 1967 discloses sensing a wide variety of lamp operating parameters in order to generate control signals which are used to control a lamp operating parameter. The embodiments disclosed include (1) sensing lamp current to control power input to the lamp, (2) sensing reactor voltage to generate a control signal which controls the lamp, (3) measuring light output from the lamp to generate a control signal which in turn controls the output of the lamp, (4) voltage across the lamp is measured and converted to a control signal which controls the output of the lamp, (5) lamp current is measured to control the lamp output, (6) both line current and lamp voltage are sensed and integrated to control lamp output, and (7) sensing input voltage variations which in turn are used to control the lamp operation.

In summary, the present state of the art has developed devices which sense a wide variety of lamp operating parameters in order to generate signals which in turn control a predetermined lamp operating parameter as desired for the operating lamp. The more advanced of these devices have their logic circuits incorporated into integrated circuit (IC) chips.

Add-on devices for modifying the performance of HID lamps on existing ballasts are known and in U.S. Pat. No. 3,925,705 dated Dec. 9, 1975 is disclosed an add-on device for lag-type ballast for reducing the wattage at which the lamp will operate.

SUMMARY OF THE INVENTION

There is provided in combination with a lead-type ballast apparatus, a device for modifying the ballast apparatus in order to program and control the operating performance of the high-intensity discharge sodium lamp as operated by the modified ballast apparatus. The basic lead-type ballast comprises an inductive reactance portion and a capacitive reactance portion. The inductive reactance portion comprises a current-limiting high-reactance transformer means having a primary winding which connects to the apparatus input terminals and a secondary winding which terminates in secondary winding output terminals. The capacitance reactance portion comprises a capacitor connected between the transformer secondary winding output terminals and the apparatus output terminals across which the lamp is connected. To initiate a discharge within the lamp, a pulse-generating means is normally associated with the transformer secondary winding and is operable to generate high-voltage pulses when the apparatus is initially energized which are applied through the capacitor and across the lamp.

The modifying device comprises an additional inductance which is connected in circuit in one of (1) a parallel connection with the capacitor of the ballast and (2) connection across the transformer secondary winding output terminals. A controlled switching means has a high impedance open position and a low impedance closed position as well as control terminal means. The switch is connected in circuit with the additional inductance means. When the switch is open, the modified ballast apparatus delivers the first level of current to an operating lamp and when the switch is closed, the modified ballast apparatus delivers a second and different level of current to an operating lamp. A sensing and programming means is operable to sense at least one predetermined lamp operating parameter and to generate an output control signal which is indicative of a predetermined parameter which is desired for the operating lamp. The sensing and programming means has an output connected to the control terminal of the switch in order to control the relative proportion of time the switch is open and closed, in order to control in programmed fashion the predetermined lamp operating parameter as desired for the operating lamp. There is also provided the modified lead-type ballast.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
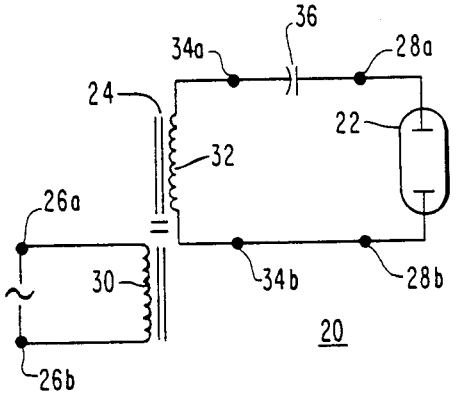
FIG. 1 is a circuit diagram of a conventional present-existing lead-type ballast wherein the lamp circuit is isolated from the line.

The conventional lead-type ballast 20 as shown in FIG. 1 is specially designed to operate one of an HID mercury lamp, an HID metal halide lamp, or an HID sodium lamp all designated 22. In this embodiment, the current-limiting high-reactance transformer 24 is so designed that the lamp circuit is isolated from the line. The ballast has input terminals 26*a*, 26*b* which are adapted to be connected across the source of AC energizing potential and apparatus output terminals 28*a*, 28*b* across which the lamp 22 to be operated is adapted to be connected. The transformer 24 is of the high-reactance type and forms the inductive reactive portion of the ballast. The transformer 24 has a primary winding means 30 which is connected to the apparatus input terminals 26*a*, 26*b* and the transformer secondary winding 32 terminates in secondary winding output terminals 34*a*, 34*b*. A capacitor 36 forms the capacitive reactance portion of the ballast and it is connected between the secondary winding output terminal 34*a* and the apparatus output terminal 28*a*.

Figure 2:
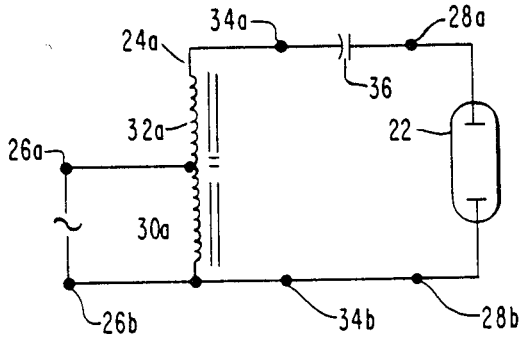
FIG. 2 is a circuit diagram of a conventional present-existing lead-type ballast which utilizes an auto-transformer.

The embodiment as shown in FIG. 2 corresponds to that shown in FIG. 1 except that the transformer 24*a* is of the auto-transformer type with all connections thereto otherwise being the same, namely, the input terminals 26*a*, 26*b*, output terminals 28*a*, 28*b*, primary winding 30*a*, secondary winding 32*a*, secondary winding output terminals 34*a*, 34*b* and capacitor 36.

Figure 3A:
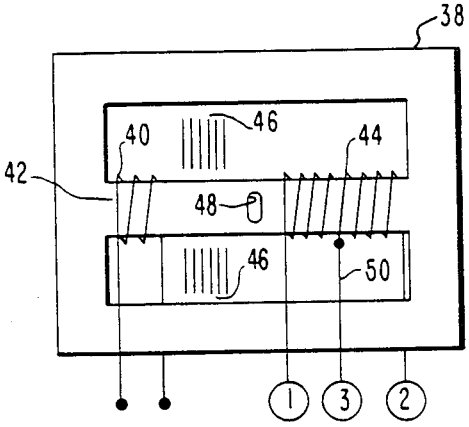
FIG. 3A illustrates the magnetic and winding details of a typical conventional lead-type ballast which is adapted to operate a high-pressure sodium lamp.

The magnetic and winding structure for a conventional lead-type ballast specially designed to operate an HID sodium lamp is shown in FIG. 3A wherein the core member 38 has the primary winding 40 carried on a center leg member 42 and the secondary winding 44 is also carried on the center leg 42 with the two windings being separated by gapped shunts 46. A slot 48 in the center leg member 42 provides proper electrical characteristics. For use with a sodium lamp, a tap 50 on the secondary winding is used to provide a high voltage starting pulse which is applied through the capacitor to the lamp.

Figure 3B:
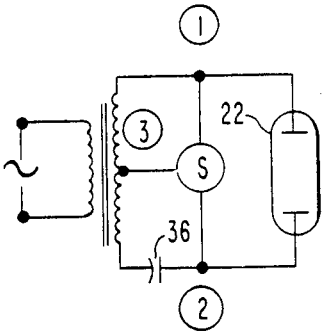
FIG. 3B illustrates the circuit connections for the magnetic and winding structure as shown in FIG. 3A.

The electrical circuit connections (1), (2) and (3) for the ballast are shown in FIG. 3B. The starter device designated "S" is generally conventional and a wide variety of designs are available, such as disclosed in U.S. Pat. No. 4,143,304, dated Mar. 6, 1979 and U.S. Pat. No. 4,072,878 dated Feb. 7, 1978. A typical starting pulse has a magnitude of 2500 V.

Figure 4:
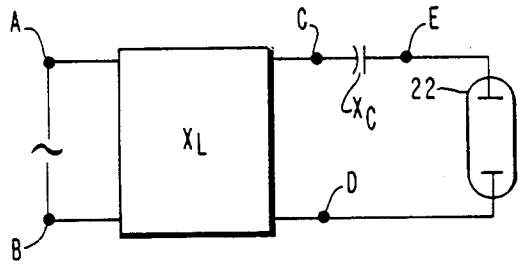
FIG. 4 illustrates the available terminals for a conventional lead-type ballast to which connection can be made for circuit modification.

In accordance with the present invention, an existing lead-type ballast member is to be modified in order to improve the performance of the operating lamp. In FIG. 4 are shown the existing terminals which are available in order to effect a modification. These include the transformer primary input terminals respectively indicated as A and B, the transformer secondary output terminals indicated as C and D and an apparatus output terminal indicated as E. The existing inductive reactance portion of the ballast which comprises the transformer is indicated in block as $X_L$ and the existing capacitive reactance portion of the ballast which connects between terminals C and E is indicated as $X_C$.

Figure 5:
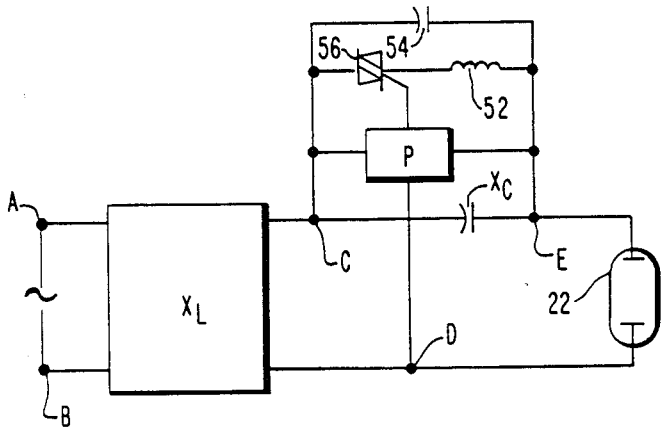
FIG. 5 is a circuit diagram of one embodiment of a modified lead ballast.

In FIG. 5 is shown a circuit diagram of a modified lead-type ballast apparatus wherein the existing elements of the apparatus are indicated generally as $X_L$ and $X_C$. In accordance with the present invention, an additional inductance means 52 is included in parallel connection with the existing capacitor means $X_C$. This inductance means 52 when included in circuit will increase the impedance and thus decrease the current which is delivered to the operating lamp 22. If the unmodified lead-type ballast and the operating lamp are matched to one another, and it is desired to maintain rated operating watts throughout lamp life, it is necessary to increase the maximum wattage drawn above the rated value. This is most easily accomplished by adding extra capacitor means 54 in parallel with the existing capacitive reactance $X_C$. Also included in circuit is a switching means 56 which is actuated by a sensing and programming means P.

Figure 6:
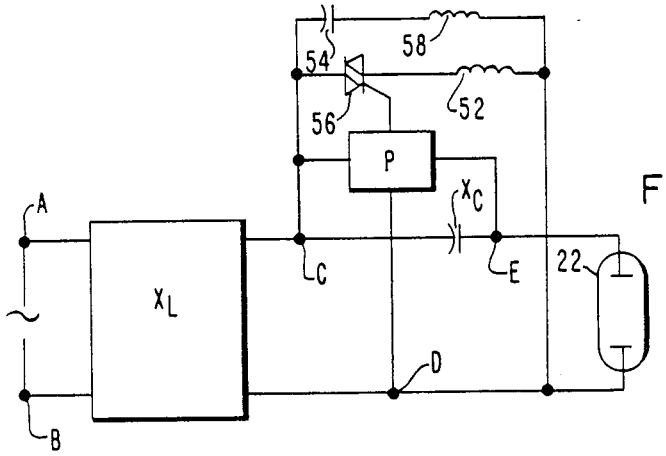
FIG. 6 is a circuit diagram of another embodiment of a modified lead ballast.

An alternative embodiment is shown in FIG. 6 wherein the additional inductor 52 is connected between circuit points C and D with the parallelling capacitor 54 connected in parallel with inductor 52. To operate a sodium lamp in such an embodiment, a small additional inductor 58 is desirably included in series with the capacitor 54, in order that the starting pulse is not shorted out.

At this point, it is desirable to review the various connections which are possible. If an additional inductance is connected across the terminals C-D, the effect is to reduce the operating lamp output since the voltage applied across the operating lamp is reduced and the current therethrough accordingly reduced. If an additional capacitance is connected across the terminals C-D, however, the effect will be to increase the lamp output since this will apply an increased voltage across an operating lamp. If an additional inductor is connected across the terminals C-E, again the lamp output will be reduced because of the increased series impedance, which will decrease the current delivered to the lamp. In similar fashion, if a capacitance is connected across the terminals C-E the lamp output will be increased because of the effect of decreased series impedance. While the circuits as described hereinbefore have utilized both a "lamp-current-reducing" additional inductor and a "lamp-current-increasing" additional capacitor, if the unmodified lead-type ballast and the lamp are not matched, the additional capacitance can be dispensed with. As an example, if the ballast is rated to operate a 300 watt sodium lamp, but the lamp as used in the modified circuit is rated at only 250 watts, then the additional capacitor can be dispensed with and the same effect achieved. If the unmodified ballast is rated at 250 watts, however, and the lamp to be operated is also rated at 250 watts, then both an additional inductor and an additional capacitor are needed if constant watts are required over the full range. In the two embodiments shown in FIGS. 5 and 6, the additional inductance means 52 is connected in circuit in one of (1) a parallel connection with the primary capacitor $X_C$ and (2) a connection across the secondary winding means output terminals, points C and D.

In both embodiments of FIGS. 5 and 6, the controlled switching means 56 which has a high impedance open position and a low impedance closed position and control terminal means, is connected in circuit with the additional inductance 52. When the switching means is open, the modified ballast delivers a first level of current to an operating lamp, and when the switching means is closed, the modified ballast delivers a second and different level of current to an operating lamp. The switching means, which can be a triac as will be described, is actuated by a sensing and programming means indicated as P which is operable to sense at least one predetermined lamp operating parameter and to generate an output signal which is indicative of a predetermined parameter desired for the operating lamp. The output of the sensing and programming means P is connected to the control terminal means of the switching means 56 in order to control the relative proportion of time that the switching means is open and closed, in order to control in programmed fashion the predetermined lamp operating parameter which is desired for the operating lamp 22. In the embodiments shown in FIGS. 5 and 6, the programming and sensing means P has inputs connected across the circuit points C-D and also across the circuit points C-E, with the latter connection providing a direct measure of lamp current. Thus both lamp voltage and lamp current are sensed and this can be converted into a wattage signal in order to control the operation of a triac 56, in accordance with the teachings set forth in heretofore referenced U.S. Pat. No. 3,590,316.

Figure 7:
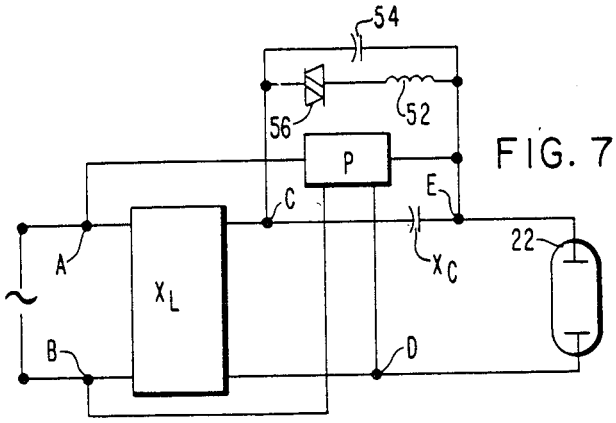
FIG. 7 is a circuit diagram of still another embodiment of a modified lead ballast wherein both line volts and lamp volts are sensed and used to control the desired operating parameter for the lamp.

In FIG. 7 is shown another embodiment wherein the additional inductor 52 and the additional capacitor 54 are both connected across the circuit points C-E. The control circuit P was fabricated in accordance with the teachings of heretofore referenced U.S. Pat. No. 4,162,429. In this embodiment, the control circuit D has its inputs connecting to the points A-B, in order to sense line voltage, and also to the points D-E, in order to sense lamp voltage. These two voltage signals are fed into a ramp capacitor to control the charging rate thereof and when the ramp capacitor achieves a predetermined level of charge during each half cycle of energizing potential, the switch 56 is gated to close same. Using this control circuit, which was available as an IC chip, the control of the wattage of the operating sodium lamp 22 was very accurate. The circuit shown in FIG. 7 has been operated extensively in two different modes. In one mode, the existing lead-type ballast $X_L$ and $X_C$ was rated to operate a 310 watt HID sodium lamp, but the lamp as operated by the modified ballast was rated at 250 watts. The value of the additional inductor 52 was 530 mH and for such a mode of operation, the additional capacitor was not needed. In another mode of operation, the existing lead-type ballast $X_L$ and $X_C$ was rated at 250 watts and this was used to operate a 250 watt HID sodium lamp. In this case, the inductance of the additional inductor 52 was 800 mH and the added capacitor 54 had a capacitance of 2 $\mu$F.

In any of the foregoing circuits, the total inductive reactance and the total capacitive reactance of the modified ballast apparatus are predetermined, in order to deliver two levels of electrical current to an operating lamp, depending upon the open or closed position of the switching means. One level of the current is greater than that current desired for an operating lamp, and the other level of current delivered to the lamp is less than that current desired for an operating lamp. The opening and closing of the switch 56 is then controlled in order to control a predetermined lamp operating parameter.

In the following Table A are listed specific values of inductive reactance and capacitive reactance for existing lead-type ballasts of two ratings which were used to operate high-pressure sodium lamps rated at 250 watts, along with the values of additional inductive reactance and capacitive reactance as used to modify the existing ballasts. For both of these examples, the additional inductor and additional capacitor, when used, were connected in parallel with the existing capacitor with the switch and additional inductor connected in series.

TABLE A

| Existing Ballast Rating | Lamp Rating | Additional Inductive Reactance | Additional Capacitive Reactance |
|---|---|---|---|
| 310 W<br>$X_L$ = 111.3 Ω*<br>$X_C$ = 75.8 Ω | 250 W | 200 Ω | not used |
| 250 W<br>$X_L$ = 154 Ω* | 250 W | 300 Ω | 1,326 Ω |

TABLE A-continued

| Existing Ballast Rating | Lamp Rating | Additional Inductive Reactance | Additional Capacitive Reactance |
|---|---|---|---|
| $X_C$ = 88 Ω | | | |

*Measured with rms open circuit voltage and short circuit current.

Figure 8:
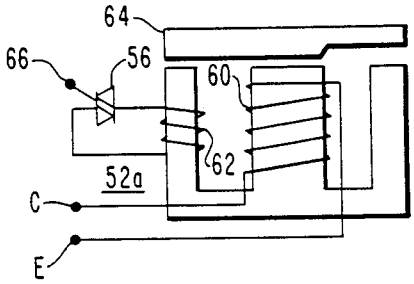
FIG. 8 illustrates magnetic and winding details and the switch connection for one embodiment of the additional switch and inductor portion of the modifying device.
Figure 9:
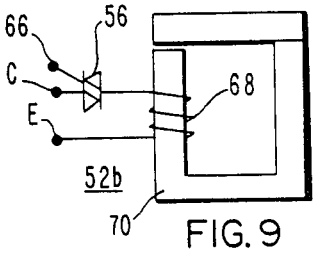
FIG. 9 illustrates magnetic and winding details and the switch connection for another embodiment of the additional switch and inductor portion of the modifying device.

Two types of switch arrangement are possible and these are disclosed in FIGS. 8 and 9. In FIG. 8, the additional inductance means 52*a* comprises a primary winding means 60 and a control winding means 62, both carried on the same magnetic structure 64. The switching means 56 is a conventional triac having open and closed positions and a control terminal 66 and the switch 56 is connected in series circuit with the control winding 62. When the switch is closed, the inductive reactance of the additional inductor 52*a* is decreased by a predetermined amount such as a factor of 3. A variable inductance of this type is shown in U.S. Pat. No. 4,162,428 dated July 24, 1979. In the embodiment as shown in FIG. 9, the additional inductor 52*b* comprises a single winding 68 carried on a magnetic core 70, with the triac 56 connected in series circuit therewith. In the FIG. 9 embodiment, when the triac 56 is open, the additional inductance is removed from circuit and the current to the operating lamp increases. In the embodiment as shown in FIG. 8, when the triac or switch 56 is open, the inductance is greater and the current to the lamp is decreased. Thus depending upon the interconnection between the switching means and the additional inductance means, opening and closing the switching means either varies the inductive reactance of the additional inductance between predetermined values or includes or removes the additional inductance means from the circuit. When the additional inductance means displays a minimum of inductance reactance or is not removed from circuit as determined by the position of the switching means, the current delivered to the operating lamp by the modified ballast apparatus has a first value, and when the additional inductance means displays a maximum of inductive reactance or is removed from circuit as determined by the position of the switching means, the current delivered to the operating lamp by the modified ballast apparatus has a second value which is greater than the first value.

While the present modified ballast apparatus serves to vary the current delivered to the operating lamp between two values, one of which is greater than desired and one of which is less than desired, this current control can be so adjusted as to effectively control any desired lamp operating parameter. In similar fashion, any of a variety of lamp operating parameters can be sensed, with the control signal derived therefrom. Following is a partial listing of lamp parameters which can be sensed along with the operating lamp parameters which can be controlled in response thereto.

| Sensed Parameter | Controlled Parameter |
|---|---|
| lamp volts | lamp volts |
| lamp volts | lamp power |
| lamp volts and line volts | lamp volts |
| lamp volts and line volts | lamp power |
| lamp current | lamp power |
| lamp power | lamp power |
| lamp continuous time of operation | lamp dimming |

-continued

| Sensed Parameter | Controlled Parameter |
|---|---|
| lamp light output | lamp power |
| lamp color | lamp volts or lamp power |

Figure 10:
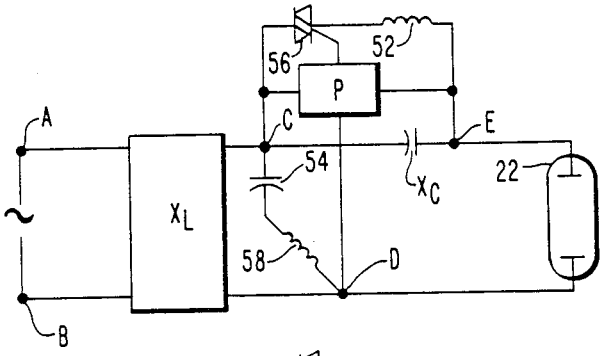
FIG. 10 is a circuit diagram of still another alternative embodiment of a modified ballast.

In FIG. 10 is shown another alternative circuit embodiment wherein the additional inductor 52 and series switch 56 are connected in series across circuit points C-E and the additional capacitor 54 and series connected small inductor 58 are connected across the points C-D. In other respects, this embodiment is similar to those previously described.

Figure 11:
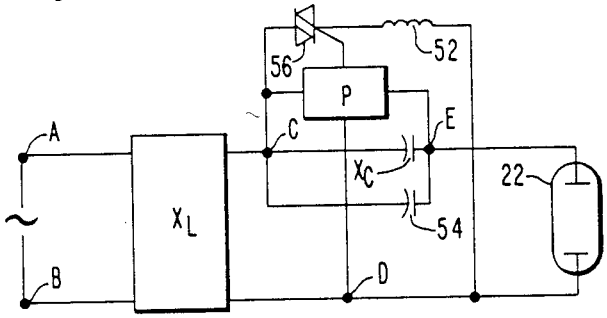
FIG. 11 is a circuit diagram of yet another embodiment of a modified ballast.

In FIG. 11 is shown another alternative embodiment wherein the additional inductor 52 and series switch 56 are connected across the points C-D and the additional capacitor 54 is connected across the points C-E. The combination of the "impedance reducing" capacitor connected between C-E and the "voltage dropping" reactor 52 connected between C-D has an advantage in that the reactor voltage rating does not have to be as high as with other embodiments. In the embodiments shown in FIGS. 5, 6, 7 and 11, the starter connection is as shown in FIG. 3B, i.e., across circuit points C-D and to a tap on the transformer secondary.

The embodiments shown in FIGS. 5 and 7 (connection C-E) offers certain advantages in that the shunt capacitance will protect the controlled switch from voltage transients, both lamp and starter pulse generated. With the lamp not operating, no voltage appears across the added or modifying components so that the no-load current of the ballast is unaffected. In all embodiments, connecting the controlled bilateral switch in series with the additional inductor provides automatic di/dt limitation and eliminates the problem of stored charge which can occur with capacitors and series switches.

The present ballast modification is extremely flexible in that it can be readily used to retrofit existing lead-type ballast in order to control and program the performance of the operating lamp. The only additional element of any appreciable size to be added by the modification is the additional inductor and in the usual case, the existing capacitor can be replaced by a slightly larger capacitor if the lamp rating is to be maintained at the same value. Alternatively, the present modified ballast can be used with new construction. Since the basic magnetics are a standard item, such new construction can also be sold with or without the ballast modification, depending upon the performance desired for the operation of the lamp.

The present modified lead-type ballast has additional advantages in that the additional switch-controlled inductor normally has a considerably smaller rating than the inductive reactance portion of the unmodified lead-type ballast. This decreases the load which is required to be switched by the bilateral switching means or triac.

The present lead-type ballast apparatus can be viewed either as a modified lead-type ballast, that is, an existing structure which is modified, or the ballast can be viewed as a new type of lead-type ballast which can be programmed in order to operate the HID lamps in predetermined fashion. In either case, the apparatus comprises the current-limiting inductive reactance portion comprising the high-reactance transformer means and the capacitive reactance portion comprising the capacitor means connected between the transformer output and the lamp to be operated, with the additional inductor which is switched in and out of circuit connected as previously described.

While the foregoing apparatus has particular utility with respect to HID sodium lamps, it can also be used to control the wattage of HID metal halide lamps which are operated from lead-type ballasts.

The circuit disclosed in copending application Ser. No. 414,115, filed concurrently herewith has been specifically tailored to operate with the modified lead-type ballast as described herein and provides greatly improved performance for the ballasted lamps. FIGS. 12–15 will be briefly described hereinafter in sufficient detail to enable this improved programming and control device to be practiced although the improved device is described in much greater detail in the foregoing copending application.

Figure 12:
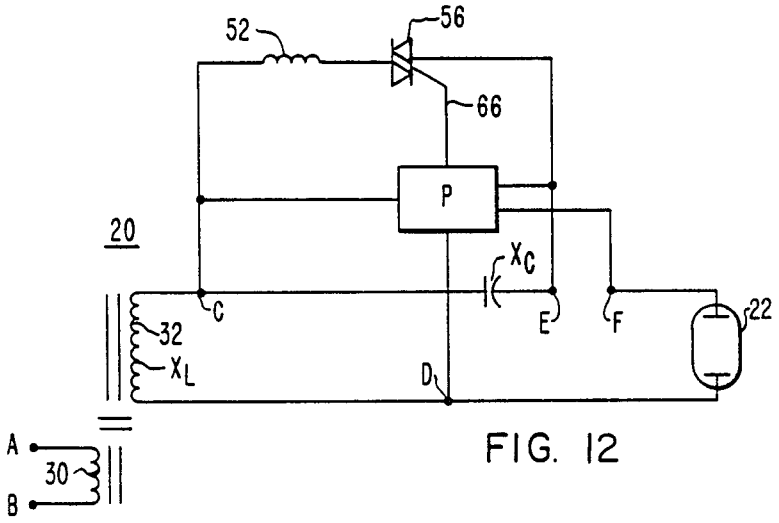
FIG. 12 is a diagram showing the circuit arrangement which incorporates the improved programming and control device of aforementioned copending application Ser. No. 414,115, filed concurrently herewith.

The general circuit arrangement which incorporates the improved programming device P is shown in FIG. 12, wherein the programming device is adapted to control lamp wattage in response to measured lamp wattage. Essentially, this overall general circuit is similar to an embodiment as previously described except that a copper current sensing strip, described hereinafter, connects between the terminals E and F. Briefly, the basic lead-type ballast apparatus 20 has apparatus input terminals A and B adapted to be connected across a source of AC energizing potential and apparatus output terminals F and D across which the lamp 22 to be operated is adapted to be connected. As in the previous embodiments, the apparatus comprises an inductive reactance portion designated $X_L$ and a capacitive reactance portion designated $X_C$. The inductive reactance portion comprises a conventional current-limiting high-reactance transformer means which has a primary winding 30 connected to the apparatus input terminals A and B and a secondary winding 32 terminating in secondary winding output terminals C and D. The capacitive reactance portion comprises the capacitor $X_C$ connected between the secondary winding means output terminal C and the terminal E and the terminal E connects to the apparatus output terminal F through a copper strip on a printed circuitboard, as will be described hereinafter. The basic modifying device comprises additional inductance means 52 connected in series with a gate-controlled AC semiconductor switching means 56 which has a high impedance open position and a low impedance closed position and gate terminal means 66 which connect to the basic sensing and programming means P.

Figure 13:
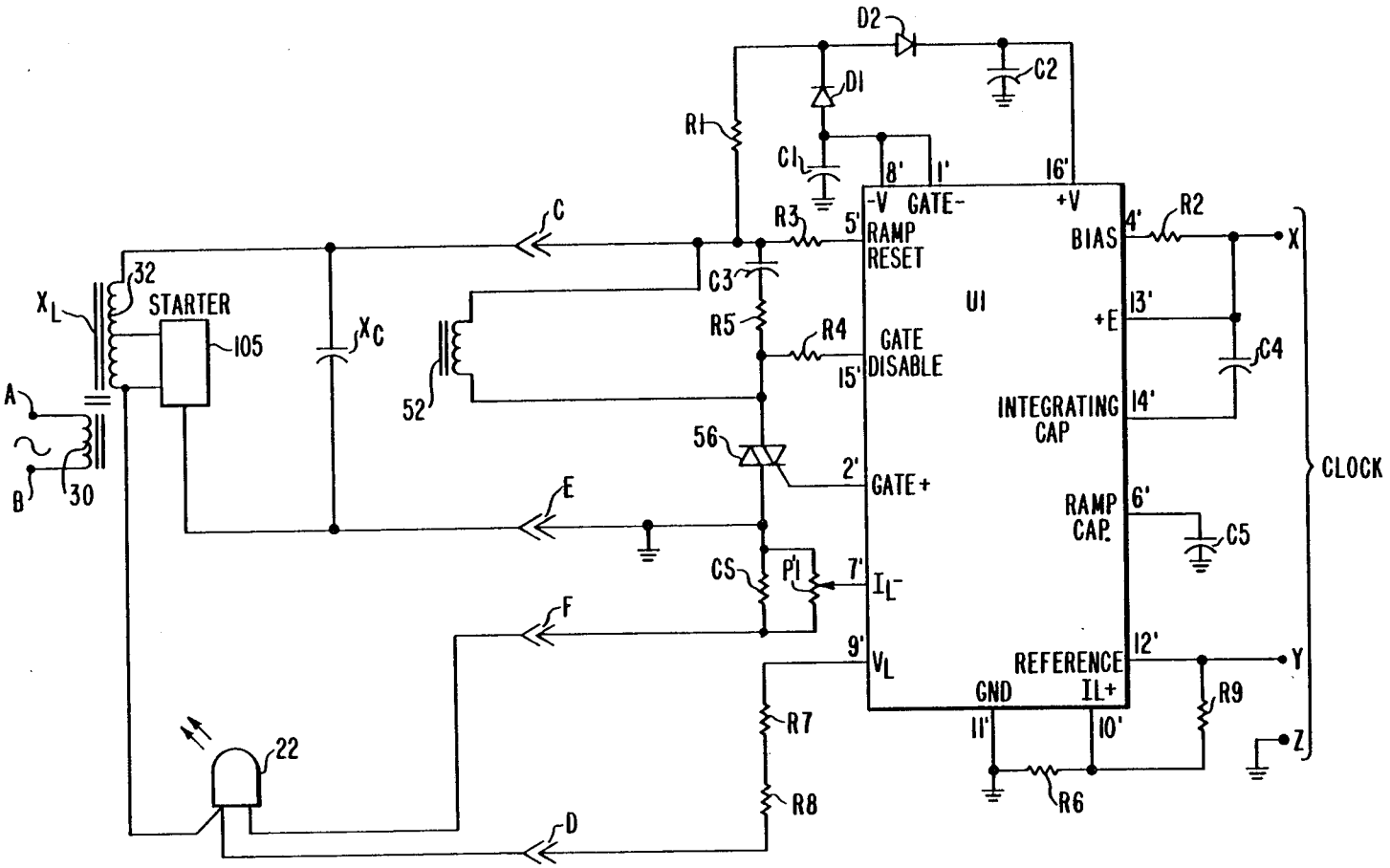
FIG. 13 is a circuit diagram of the sensing and programming means of copending application Ser. No. 414,115, filed concurrently herewith when it is formed as a power regulating module.

In FIG. 13 is shown the schematic diagram for a module which measures lamp power in order to regulate lamp power. The circuit is designed around a 16 pin semicustom integrated circuit U1 which will be described hereinafter. More specifically, the circuit connections between the power regulating module and the conventional ballasting components are shown as connection points C, D, E and F. The high reactance transformer $X_L$ has its primary winding 30 adapted to be connected to the power input terminals A, B and a conventional starter circuit 105 cooperates with the secondary winding 32 to provide the high voltage starting pulses.

In the operation of the device, lamp current and lamp voltage are sensed and are fed to a multiplier circuit which computes the instantaneous lamp power, with the resulting signal compared to a reference value. The resulting error signal is fed into an integrating capacitor which has a DC voltage output which slowly increases if the desired power exceeds the actual value. If the lamp power is two large, the capacitor voltage will slowly decrease. The integrating capacitor voltage is compared to a voltage ramp signal and the comparator output feeds the AC switch gate current generating circuit. The gate current signal can exist whenever the ramp generator voltage exceeds the capacitor voltage and once the AC switch 56 is turned on, a signal is produced by the switch anode voltage such that the gate current is turned off, in order to minimize power supply requirements.

In the operation of this power control device, lamp current is sensed by the 20 milliohm current shunt CS which is formed by a copper track on a printed circuitboard. A detailed explanation of the operation of the circuit is provided in aforementioned copending application Ser. No. 414,115, filed concurrently herewith. In the following Table I is set forth a parts list for the power regulating module as shown in FIG. 13.

TABLE I

POWER REGULATING MODULE

| COMP | DESCRIPTION | VALUE Ω | | | MFG. NUMBER | MFG. |
|---|---|---|---|---|---|---|
| R1 | Resistor | 100K | 5% | 2 W | | |
| R2 | Resistor | 1.5 M | 5% | .25 W | | |
| R3 | Resistor | 4.7 M | 5% | .25 W | | |
| R4 | Resistor | 4.7 M | 5% | .25 W | | |
| R5 | Resistor | 2K | 5% | .25 W | | |
| R6 | Resistor | 300 | 5% | .25 W | | |
| R7 | Resistor | 1 M | 5% | 1 W | | |
| R8 | Resistor | 1 M | 5% | 1 W | | |
| R9 | Resistor | 1 M | 5% | .25 W | | |
| C1 | Capacitor | 18 MFD | 20% | 15 V | 196D186X0015JA1 | Sprague |
| C2 | Capacitor | 18 MFD | 20% | 15 V | 196D186X0015JA1 | Sprague |
| C3 | Capacitor | .028 MFD | 5% | 600 V | 715P2856LD3 | Sprague |
| C4 | Capacitor | 1 MFD | 10% | 50 V | RA1A105K | IMB |
| C5 | Capacitor | .015 MFD | 20% | 50 V | CW15-50-100-M | Central Lab |
| D1 | Diode | 400 mA | | 225 V | 1N645 | Gen Inst |
| D2 | Diode | 400 mA | | 225 V | 1N645 | Gen Inst |
| P'1 | Potentiometer | 200 | 10% | 1 Turn | 3386-P-1-201 | Bourns |
| 56 | AC Switch | 4 A | | 600 V | Q6004 L4 | Teccor |
| U1 | Integrated Ckt | | | | MOA2953 A81158 | Interdesign |
| Printed Circuit Board | | | | | | |
| | Terminals | | | | 62409-1 | AMP |
| CS | Current-Sensing Copper Strip on P.C. Board | | | | | |

Figure 14:
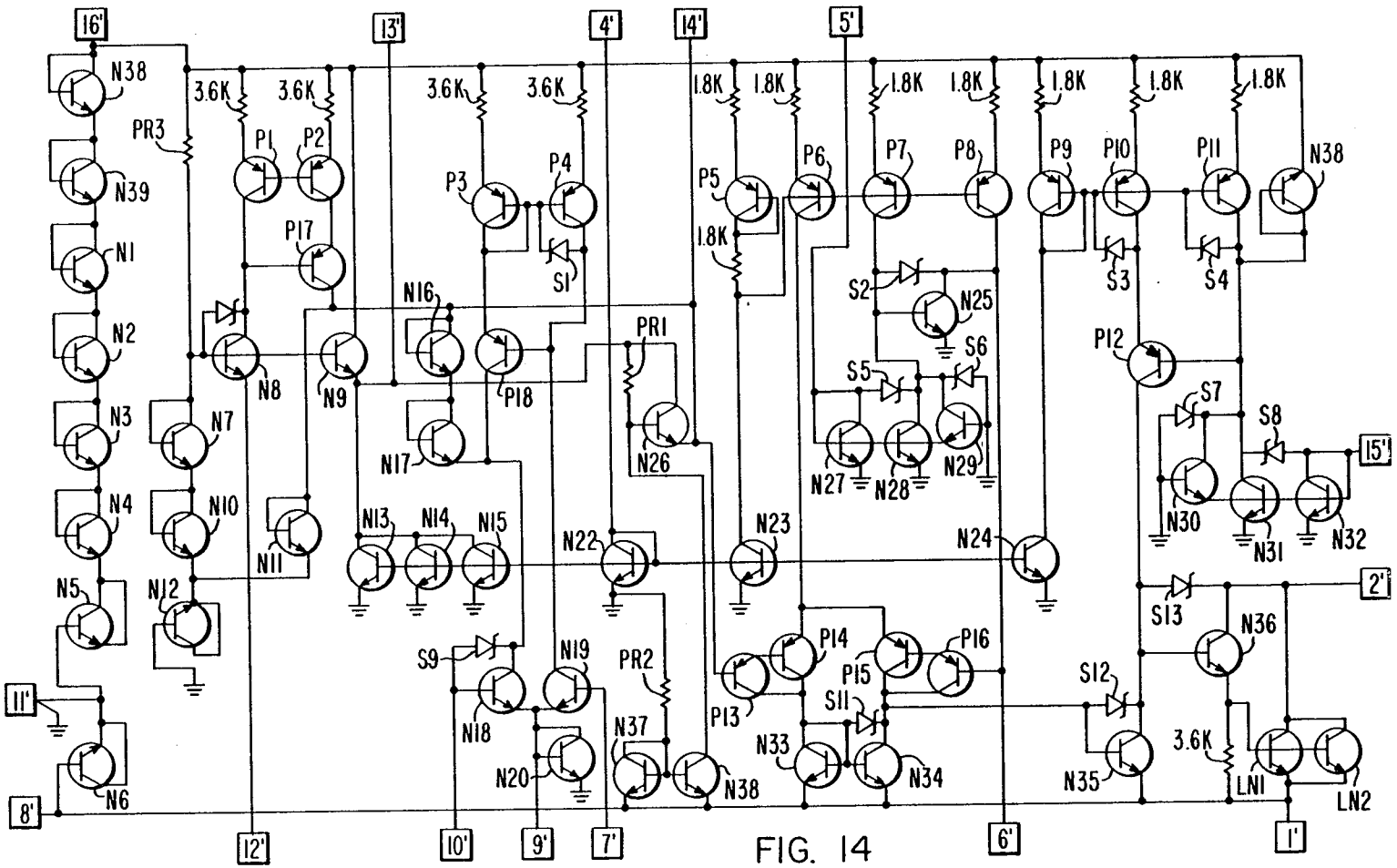
FIG. 14 is a circuit diagram of the I.C. chip portion of the module as shown in FIG. 13.

In FIG. 14 is shown the circuit diagram for the semi-custom integrated chip U1. The I.C. design is based upon a "master array" concept which yields silicon wafers with thousands of identical "chips" which are completely processed except for the final design interconnect pattern of the surface of the chip. When the pattern is etched into the aluminum surface, the chip forms the unique circuit desired. The process can be compared to that of having a printed circuitboard assembled with a large number of components (approximately 300) such as resistors, diodes, and NPN and PNP transistors before the copper of the PC board has been etched to form the circuit. The circuit for the processed chip is shown in detail in FIG. 14 and for a detailed description thereof, reference is made to copending application Ser. No. 414,115, filed concurrently herewith.

In the following Table II is a listing of the I.C. pins as identified by their general label and function which is performed at each pin.

TABLE II

DESCRIPTION OF I.C. PINS

| PIN | LABEL | FUNCTION |
|---|---|---|
| 1' | GATE− | Negative (Emitter) side of 200 mA NPN Switch which is used to turn the AC switch on by connecting the gate to a negative voltage source. |
| 2' | GATE+ | Positive (Collector) side of NPN Switch |
| 3' | Not Used or Shown | |
| 4' | BIAS | Current $I_b$ (bias current) into this terminal forms a source for various internal biasing circuits and current references. The value of $I_b$ can range from 5 to 50 μA. The voltage at the terminal is 0.7 V above GND terminal 15'. |
| 5' | RAMP RESET | Whenever the magnitude of the current in or out of this terminal drops below 2 $I_b$, the RAMP CAP terminal 6' is shorted to the GND terminal 15' by an NPN transistor. Maximum current should be limited to ± 300 μA. The voltage clamps at ± 0.7 V. |
| 6' | RAMP CAP | The current flow out of this terminal equals 2 $I_b$ and is used to turn a linear voltage ramp signal. The voltage range is form ≃0 V (reset active) to ≃ + V. The voltage at this terminal is internally compared with the voltge at INTEGRATING CAP terminal 14' to control the gate current. |
| 7' | $I_L$ | The voltage difference between this terminal and $I_{L+}$ is used in combination with the current flow out of $V_L$ terminal 9" to form a transconductance multiplier whose output is proportional to instantaneous lamp power. The multiplier is a single quadrant design which functions when $I_{L-}$ − $I_{L+}$ is >0 (for best linearity ≤ 30 mV) and the current from $V_L$ terminal is positive. In the lamp voltage regulating configuration the multiplier is converted to a single transistor, grounded base, network whose output equals the current flowing from $V_L$ terminal 9". This is accomplished by |

TABLE II-continued

| DESCRIPTION OF I.C. PINS | | |
|---|---|---|
| PIN | LABEL | FUNCTION |
| | | connecting $I_L$ to $V_L$ and grounding $I_L$. |
| 8' | V | Negative shunt regulator referenced to GND terminal 11'. Voltage is nominally - 6.7 V. Current flow from terminal 8' should be limited to less than 10 mA. The substrate of the chip is connected to - V and thus all other chip terminals must be positive with respect to -V. |
| 9' | $V_L$ | See description of Pin 7'. |
| 10' | $I_L$ | See description of Pin 7'. |
| 11' | GND | Ground reference of circuit. |
| 12' | REFERENCE | Voltage at this terminal (nominal value of 7.4 V) is temperature compensated and independent of the ripple voltage of + V terminal 16'. The current flow from this terminal is internally compared to the output of the multiplier and thus forms the power reference signal. Current should nominally be 10–20 μA. |
| 13' | +E | Voltage at this terminal is nominally 7.4 V. Terminal can source about 300 μA and can sink 3 $I_b$ and can thus handle ripple current of the integrating capacitor. |
| 14' | INTEGRATING CAP | This high impedance terminal is the summing point for the current proportional to lamp power and the power reference $I_{REF}$. Voltage can range from 1 V to 7.4 V. |
| 15' | GATE DISABLE | The AC switch gate current circuit is disabled whenever the current flow from or to this terminal exceeds $I_b$. The current should be limited to ± 300 μA and the voltage is internally limited to ± 0.7 V. |
| 16' | +V | A shunt 10.9 V Zener referenced to GND terminal 11'. The current flow should be limited to 10 mA and the terminal must be most positive of chip. |

In the following Table III is a general description of the components of the I.C. chip.

TABLE III

| DESCRIPTION OF I.C. CHIP COMPONENTS | |
|---|---|
| Chip Component | Description |
| N 1 through 40 | NPN transistors (signal level) |
| P 1 through 18 | PNP transistors (signal level) |
| S 1 through 13 | Schottky diodes |
| LN1 and LN2 | Medium power level NPN transistors |
| PR1 and PR2 | Pinch resistors 130 KΩ |
| PR 3 | Pinch resistor 100 KΩ |
| Other resistors | 3.6 KΩ or 1.8 KΩ as marked |

Figure 15:
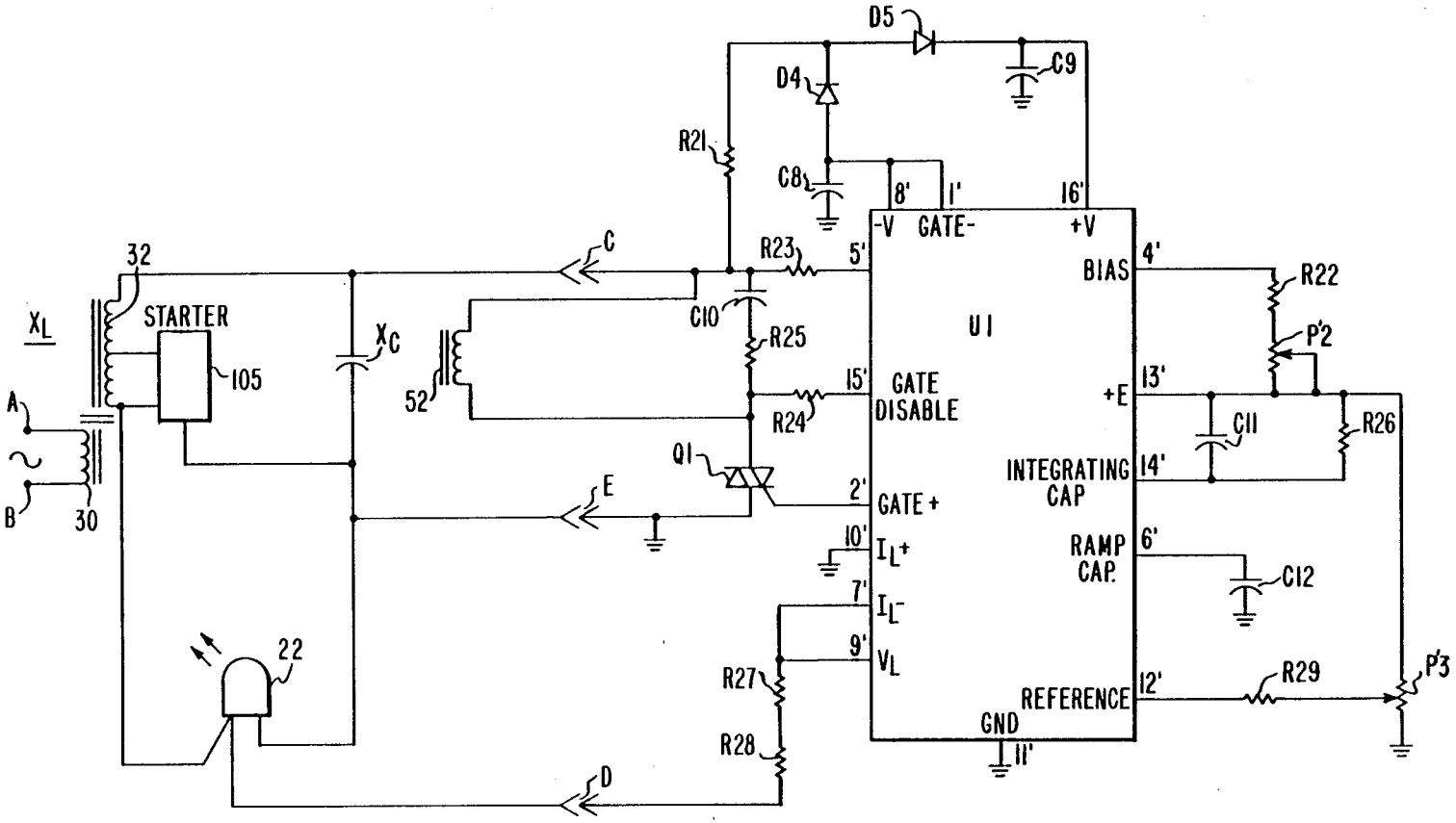
FIG. 15 is a circuit diagram of a control module as disclosed in copending application Ser. No. 414,115, filed concurrently herewith wherein lamp voltage is sensed in order to control lamp wattage.

In some types of HID sodium lamps which are designed for improved color rendition, such as described in U.S. Pat. No. 4,230,964, dated Oct. 28, 1980, the lamp may exhibit an emission color which is subject to change with substantial increases in operating lamp voltages as are normally encountered during normal lamp life. In such case, it is desirable to minimize the lamp voltage changes as much as possible. The control device as disclosed in the aforementioned copending application Ser. No. 414,115 can be modified so that the lamp operating voltage is periodically measured in order to generate output signals which are representative of the measured voltage developed across the operating lamp. These signals are then used to actuate means which causes the gate drive of the AC switch to be actuated at a predetermined earlier time in each half cycle of the AC energizing potential as the measured lamp voltage increases. In other words, as the lamp operating voltage increases, the lamp wattage consumption is decreased at a predetermined rate in order that lamp voltage increase is minimized. In FIG. 15 is shown a module which operates to measure lamp voltage in order to decrease lamp power with increasing lamp voltage. In this embodiment, the semi-custom integrated chip U1 is identical with the chip as described in the previous power control embodiment and in the following Table IV is set forth the parts list for the voltage responsive control module as illustrated in FIG. 15.

TABLE IV

| COMP | DESCRIPTION | VALUE Ω | | | MFG. NUMBER | MFG. |
|---|---|---|---|---|---|---|
| R21 | Resistor | 100K | 5% | 2 W | | |
| R22 | Resistor | 330K | 5% | .25 W | | |
| R23 | Resistor | 4.7 M | 5% | .25 W | | |
| R24 | Resistor | 4.7 M | 5% | .25 W | | |
| R25 | Resistor | 2K | 5% | .25 W | | |
| R26 | Resistor | 680K | 5% | .25 W | | |
| R27 | Resistor | 2.7 M | 5% | 1 W | | |
| R28 | Resistor | 2.7 M | 5% | 1 W | | |
| R29 | Resistor | 330K | 5% | 25 W | | |
| C8 | Capacitor | 18 MFD | 20% | 15 V | 196D186X0015JA1 | Sparague |
| C9 | Capacitor | 18 MFD | 20% | 15 V | 196D186X0015JA1 | Sprague |
| C10 | Capacitor | .028 MF | 5% | 600 V | 715P3358LD3 | Sprague |
| C11 | Capacitor | 1 MFD | 10% | 50 V | RA1A105K | IMB |
| C12 | Capacitor | .015 MFD | 20% | 50 V | CW15-50-100-M | Central Lab |
| D4 | Diode | 400 mA | | 225 V | 1N645 | Gen Inst |
| D5 | Diode | 400 mA | | 225 V | 1N645 | Gen Inst |
| P'2 | Potentiometer | 1 M | 10% | 1 Turn | 3386-P-1-105 | Bourns |
| P'3 | Potentiometer | 500 K | 10% | 1 Turn | 3386-P-1-504 | Bourns |
| 56 | AC Switch | 4 A | | 600 V | Q6004 L4 | Teccor |
| U1 | Integrated Ckt | | | MOA2953 | | Interdesign |
| | Printed Circuit Board | | | | A81164 | |
| | Terminals | | | | 62409-1 | AMP |

The preferred packaging for both the add-on inductor and the control circuitry is a unitary member shaped like a conventional capacitor can, in order to facilitate mounting of same in a conventional luminaire which usually has provision for mounting a second capacitor, but which normally is not needed. This is disclosed in further detail in previously referenced copending application Ser. No. 414,275, filed concurrently herewith. The actual value of the add-on inductor 52 which is utilized is not critical. The only requirement is that, with the reactor control fully phased "on", the controller can prevent the lamp watts exceeding the predetermined desired value with +10% input voltage. Any lower value of inductance will effectively increase the gain of the system since the switch 56 will not have to phase forward as much to obtain the same control level for use in the embodiment such as is shown in FIG. 12.

For the power control function, the same value of inductor 52 is used for all ballast power ratings, i.e., the ratio of impedance presented by the reactor 52 and capacitor $X_C$ in parallel, compared to the impedance of the capacitor $X_C$ alone, is approximately the same for all ballast power levels for a circuit arrangement such as is shown in FIG. 12. Since power in the lamp is proportional to lamp current (at a given lamp voltage) the same percentage change can be made in lamp current for any ballast rating. A typical rating for the inductor 52 is 159 mH. For use with the voltage control module, the same inductor can be used.

I claim:

1. In combination with a lead-type ballast apparatus for operating a high-intensity-discharge lamp, a device for modifying said ballast apparatus in order to program and control the operating performance of the high-intensity-discharge lamp as operated by said modified ballast apparatus;

said lead-type ballast apparatus having apparatus input terminals adapted to be coupled to a source of AC energizing potential and apparatus output terminals across which said lamp to be operated is adapted to be coupled; and said lead-type ballast apparatus comprising an inductive reactance portion and a capacitive reactance portion, said inductive reactance portion comprising a current-limiting high-reactance transformer means having primary winding means coupled to said apparatus input terminals and secondary winding means coupled to the secondary winding means output terminals, said capacitive reactance portion comprising capacitor means coupled between said secondary winding means output terminals and said apparatus output terminals; said modifying device comprising:

additional inductance means coupled in circuit in one of (1) a parallel coupling with said capacitor means, and (2) a coupling across said secondary winding means output terminals, controlled switching means having a high impedance open position and a low impedance closed position and control terminal means, said switching means being coupled in circuit with said additional inductance means so that when said switching means is open, said modified ballast apparatus delivers a first level of current to an operating lamp, and when said switching means is closed, said modified ballast apparatus delivers a second and different level of current to an operating lamp; and sensing and programming means operable to sense at least one predetermined lamp operating parameter and to generate an output control signal which is indicative of a predetermined parameter desired for said operating lamp, and said sensing and programming means having an output connected to the control terminal means of said switching means to control the relative proportion of time said switching means is open and closed in order to control in programmed fashion the predetermined lamp operating parameter desired for said operating lamp.

2. The combination as specified in claim 1, wherein said lamp to be operated is an HID sodium lamp and wherein the total inductive reactance and the total capacitive reactance of said modified ballast apparatus are predetermined in order to deliver two levels of electrical current to an operating lamp, depending upon the open or closed position of said switching means, one level of said current being greater than the average current desired for an operating lamp, and the other level of said current being less than the average current desired for an operating lamp.

3. The combination as specified in claim 2, wherein said switching means is a bilateral switching means.

4. The combination as specified in claim 3, wherein said switching means is connected in series circuit with said additional inductance means.

5. The combination as specified in claim 3, wherein said additional inductance means comprises a magnetic structure, a primary winding means and a control winding means both of which are carried on said magnetic structure, said switching means being connected in series circuit with said control winding means, and closing of said switching means decreases by a predetermined amount the inductive reactance of said additional inductance means.

6. The combination as specified in claim 2, wherein said switching means is a bilateral switching means, and said additional inductance means is connected across said secondary winding means output terminals.

7. The combination as specified in claim 6, wherein said bilateral switching means is connected in series circuit with said additional inductance means.

8. The combination as specified in claim 6, wherein said additional inductance means comprises a magnetic structure, a primary winding means and a control winding means both carried on said magnetic structure, said switching means being connected in series circuit with said control winding means, and closing of said switching means decreases by a predetermined amount the inductive reactance of said additional inductance means.

9. The combination as specified in claim 2, wherein said modifying device incorporates additional capacitor means connected in circuit in one of (1) a parallel connection with said lead-type ballast capacitor means and (2) a connection across said secondary winding means output terminals, said additional capacitor means being one of (1) a small additional capacitor and (2) an additional capacitor having a capacitance which is a predetermined amount greater than the capacitance of said capacitive reactance portion of said lead-type ballast apparatus and which is used to replace said lead-type ballast capacitor means.

10. In combination with a lead-type ballast apparatus for operating a high-intensity-discharge sodium lamp, a device for modifying said ballast apparatus in order to program and control the operating performance of the sodium lamp as operated by said modified ballast apparatus;

said lead-type ballast apparatus having apparatus input terminals adapted to be connected across a source of AC energizing potential and apparatus output terminals across which said lamp to be operated is adapted to be connected; and said lead-type ballast apparatus comprising an inductive reactance portion and a capacitive reactance portion, said inductive reactance portion comprising a current-limiting high-reactance transformer means having primary winding means connected to said apparatus input terminals and secondary winding means terminating in secondary winding means output terminals, said capacitive reactance portion comprising capacitor means connected between said secondary winding means output terminals and said apparatus output terminals, and pulse-generating means associated with said secondary winding means and operable to generate high-voltage pulses when said apparatus is initially energized which are applied through said capacitor means to initiate a discharge within the sodium lamp to be operated; said modifying device comprising:

additional inductance means connected in circuit in one of (1) a parallel connection with said capacitor means and (2) connection across said secondary winding means output terminals;

controlled switching means having a high impedance open position and a low impedance closed position and control terminal means, said switching means connected in circuit with said additional inductance means and depending upon the interconnection between said switching means and said additional inductance means, opening and closing said switching means either varies the inductive reactance of said additional inductance means between predetermined values or includes or removes said additional inductance means from circuit; when said additional inductance means displays a minimum of inductive reactance or is not removed from circuit as determined by the position of said switching means, the current delivered to said operating lamp by said modified ballast apparatus has a first value, when said additional inductance means displays a maximum of inductive reactance or is removed from circuit as determined by the position of said switching means, the current delivered to said operating lamp by said modified ballast apparatus has a second value which is greater than said first value; and sensing and programming means operable to sense at least one predetermined lamp operating parameter and to generate an output control signal which is indicative of a predetermined parameter desired for said operating lamp, and said sensing and programming means having an output connected to the control terminal means of said switching means to control the relative proportion of time said switching means is open and closed in order to control in programmed fashion the predetermined lamp operating parameter desired for said operating lamp.

11. The combination as specified in claim 10, wherein the total inductive reactance and the total capacitive reactance of said modified ballast apparatus are predetermined in order to deliver two levels of electrical current to an operating lamp, depending upon the open or closed position of said switching means, one level of said current being greater than the average current desired for an operating lamp, and the other level of said current being less than the average current desired for an operating lamp.

12. The combination as specified in claim 11, wherein said switching means is a bilateral switching means, and said additional inductance means is connected in parallel connection with said capacitor means.

13. The combination as specified in claim 12, wherein said bilateral switching means is connected in series circuit with said additional inductance means.

14. The combination as specified in claim 12, wherein said additional inductance means comprises a magnetic structure, a primary winding means and a control winding means both of which are carried on said magnetic structure, said switching means being connected in series circuit with said control winding means, and closing of said switching means decreases by a predetermined amount the inductive reactance of said additional inductance means.

15. The combination as specified in claim 11, wherein said switching means is a bilateral switching means, and said additional inductance means is connected across said secondary winding means output terminals.

16. The combination as specified in claim 15, wherein said switching means is connected in series circuit with said additional inductance means.

17. The combination as specified in claim 15, wherein said additional inductance means comprises a magnetic structure, a primary winding means and a control winding means both of which are carried on said magnetic structure, said switching means being connected in series circuit with said control winding means, and closing of said switching means decreases by a predetermined amount the inductive reactance of said additional inductance means.

18. The combination as specified in claim 11, wherein said modifying device incorporates additional capacitor means connected in circuit in one of (1) a parallel connection with said lead-type ballast capacitor means and (2) a connection across said secondary winding means output terminals, said additional capacitor means being one of (1) a small additional capacitor and (2) an additional capacitor having a capacitance which is a predetermined amount greater than the capacitance of said capacitive reactance portion of said lead-type ballast apparatus and which is used to replace said lead-type ballast capacitor means, and a relatively small second additional inductance means is included in series circuit with said additional capacitor means when said additional capacitor means is connected in circuit across said secondary winding means output terminals.

19. The combination as specified in claim 11, wherein said sensing and programming means senses both operating lamp voltage and line voltage to generate a control signal which is indicative of the operating lamp wattage desired for said operating lamp, and said control signal is applied to the output terminal means of said switching means to control the operating wattage of said lamp at about a predetermined desired value.

20. A lead-type ballast apparatus for operating a high-intensity-discharge sodium lamp, said lead-type ballast apparatus being programmed in order to control in predetermined fashion the operating performance of the high-intensity-discharge sodium lamp as operated by said lead-type ballast apparatus;

said lead-type ballast apparatus having apparatus input terminals adapted to be connected across a source of AC energizing potential and apparatus output terminals across which said lamp to be operated is adapted to be connected; and said lead-type ballast apparatus comprising a current-limiting inductive reactance portion and a capacitive reactance portion, said inductive reactance portion comprising a high-reactance transformer means having primary winding means connected to said apparatus input terminals and secondary winding means terminating in secondary winding means output terminals, said capacitive reactance portion comprising capacitor means connected between said secondary winding means output terminals and said apparatus output terminals, and pulse-generating means associated with said secondary winding means and operable to generate high-voltage pulses when said apparatus is initially energized which are applied through said capacitor means to initiate a discharge within the lamp to be operated;

additional inductance means connected in circuit in one of (1) a parallel connection with said capacitor means, and (2) a connection across said secondary winding means output terminals;

controlled switching means having a high impedance open position and low impedance closed position and control terminal means, said switching means connected in circuit with said additional inductance means, when said switching means is open said lead-type ballast apparatus delivers a first level of current to an operating lamp, and when said switching means is closed said lead-type ballast apparatus delivers a second and different level of current to an operating lamp; and sensing and programming means operable to sense at least one predetermined lamp operating parameter and to generate an output control signal which is indicative of a predetermined parameter desired for said operating lamp, and sensing and programming means having an output connected to the control terminal means of said switching means to control the relative proportion of time said switching means is open and closed in order to control in programmed fashion the predetermined lamp operating parameter desired for said operating lamp.

21. The lead-type ballast apparatus as specified in claim 20, wherein the total inductive reactance and the total capacitive reactance of said lead-type ballast apparatus are predetermined in order to deliver two levels of electrical current to an operating lamp depending upon the open or closed position of said switching means, one level of said current being greater than the average current desired for an operating lamp, and the other level of said current being less than the average current desired for an operating lamp.

22. A lead-type ballast apparatus for operating a high-intensity-discharge sodium lamp, said lead-type ballast apparatus being programmed in order to control in predetermined fashion the operating performance of the sodium lamp as operated by said lead-type ballast apparatus;

said lead-type ballast apparatus comprising a current-limiting inductive reactance portion and a capacitive reactance portion, said current-limiting inductive reactance portion comprising a high-reactance transformer means having primary winding means connected to said apparatus input terminals and secondary winding means terminating in secondary winding means output terminals, said capacitive reactance portion comprising capacitor means connected between said secondary winding means output terminals and said apparatus output terminals, and pulse-generating means associated with said secondary winding means and operable to generate high-voltage pulses when said apparatus is initially energized which are applied through said capacitor means to initiate a discharge within the lamp to be operated;

additional inductance means connected in circuit in one of (1) a parallel connection with said capacitor means and (2) connection across said secondary winding means output terminals;

controlled switching means having a high impedance open position and a low impedance closed position and control terminal means, said switching means connected in circuit with said additional inductance means and depending upon the interconnection between said switching means and said additional inductance means, opening and closing said switching means either varies the inductive reactance of said additional inductance means between predetermined values or includes or removes said additional inductance means from circuit; when said additional inductance means displays a minimum of inductive reactance or is not removed from circuit as determined by the position of said switching means, the current delivered to said operating lamp by said lead-type ballast apparatus has a first value, when said additional inductance means displays a maximum of inductive reactance or is removed from circuit as determined by the position of said switching means, the current delivered to said operating lamp by said lead-type ballast apparatus has a second value which is greater than said first value; and sensing and programming means operable to sense at least one predetermined lamp operating parameter and to generate an output control signal which is indicative of a predetermined parameter desired for said operating lamp, and said sensing and programming means having an output connected to the control terminal means of said switching means to control the relative proportion of time said switching means is open and closed in order to control in programmed fashion the predetermined lamp operating parameter desired for said operating lamp.

23. The ballast apparatus as specified in claim 22, wherein the total inductive reactance of said ballast apparatus and the total capacitive reactance of said ballast apparatus are predetermined in order to deliver two levels of electrical current to an operating lamp depending upon the open or closed position of said switching means, one level of said current being greater than the average current desired for an operating lamp, and the other level of current being less than the average current desired for an operating lamp.

24. In combination with a lead-type ballast apparatus for operating a high-intensity-discharge lamp, a device for modifying the operation of said ballast apparatus in order to control the operating performance of the high-intensity-discharge lamp, wherein the lead-type ballast apparatus has a primary winding coupled to apparatus input terminals, a secondary winding and a capacitor coupled to the secondary winding and adapted to be coupled to the lamp, wherein the impedance of ballast apparatus is predominantly capacitive, said modifying device comprising:

an additional inductor coupled in circuit in one of (1) a parallel coupling with said capacitor and (2) a coupling across said secondary winding;

controlled switching means having a high impedance open position and a low impedance closed position and a control input, said switching means being coupled in circuit with said additional inductor so that when said switching means is in the open position, the modified ballast apparatus delivers a first level of current to a lamp, and when the switching means is in the closed position, the modified ballast apparatus delivers a second and different level of current to a lamp; and control means coupled to the control input of the controlled switching means, for providing a control signal to the controlled switching means to control the relative proportion of time the switching means is in the open and closed positions in order to control the operation of the lamp.

* * * * *